United States Patent [19]

Johnson et al.

[11] 4,126,497

[45] Nov. 21, 1978

[54] DOUBLE-BASE NITROCELLULOSE PROPELLANT

[75] Inventors: Craig E. Johnson, Indian Head; Paul F. Dendor, Oxon Hill, both of Md.

[73] Assignee: The United States of America as represented by the Secretary of the Navy, Washington, D.C.

[21] Appl. No.: 424,587

[22] Filed: Dec. 13, 1973

[51] Int. Cl.[2] ..... C06B 25/20; C06B 25/18; C06B 21/00

[52] U.S. Cl. ..... 149/100; 149/96; 264/3 R

[58] Field of Search ..... 149/96, 99, 100; 264/3 R

[56] References Cited

U.S. PATENT DOCUMENTS

| | | | |
|---|---|---|---|
| 2,967,098 | 1/1961 | Weil | 149/96 |
| 3,311,513 | 3/1967 | Forrest | 149/96 |
| 3,317,361 | 5/1967 | Hopper | 149/18 |
| 3,378,611 | 4/1968 | Kincaid | 264/3 R |
| 3,422,169 | 1/1969 | Brooks | 264/3 R |
| 3,422,170 | 1/1969 | Brooks | 264/3 R |
| 3,639,183 | 2/1972 | Crescenzo | 149/96 |
| 3,676,533 | 7/1972 | Dehm | 149/96 |
| 3,689,331 | 9/1972 | Pierce | 149/96 |
| 3,723,202 | 3/1973 | Butler | 149/19 |

*Primary Examiner*—Samuel W. Engle
*Assistant Examiner*—Donald P. Walsh
*Attorney, Agent, or Firm*—R. S. Sciascia; A. L. Branning; H. B. Field

[57] ABSTRACT

A double base propellant having plasticizer and ballistic modifiers uniformly dispersed therein is formed by using high speed, high shear techniques. The method of uniformly incorporating plasticizers and ballistic modifiers in a solventless process for preparing nitrocellulose is accomplished by forming a slurry of nitrocellulose under high shear, high speed mixing, adding the plasticizers and modifiers thereto and recovering the propellant.

16 Claims, No Drawings

DOUBLE-BASE NITROCELLULOSE PROPELLANT

BACKGROUND OF THE INVENTION

It is known to produce double base explosive formulations of nitrocelulose (also known as NC) by slurrying NC, water and plasticizer in a propeller mixer or with similar agitation. The slurry is then partially dried and further subjected to a high degree of mechanical working in order to achieve a propellant formulation having the desired consistency and composition. For example, various hot rolling techniques must be used to make a colloid of the nitrocellulose, drive off the remaining water, and form a sheet material. The sheet material must then be further processed to a form, such as strips, to make it suitable for loading into a vacuum type press for final extruding.

As can be seen the prior art methods and compositions require a substantial amount of working and reworking to obtain a plasticized nitrocellulose in the desired form. Also, the working methods require a substantial amount of skill to reduce the likelihood of an undesired explosion. With the prior art methods however, the possibility of an explosion is always present.

In addition to requiring a multitude of steps to form the desired plasticized nitrocellulose, the prior art methods are not as successful as the instant invention in forming a propellant having the components thereof uniformly distributed throughout the binder. It is desirable to have all components of the propellant uniformly distributed therein. But the prior art methods and propellants have great difficulty in achieving the desired uniformity especially because a double-based propellant comprising an energetic binder and an energetic plasticizer can explode. Thus it is desirable to avoid hot rolling steps and preextrusion shaping.

SUMMARY OF THE INVENTION

It is accordingly an object of this invention to provide a method which requires fewer steps to formulate a nitrocellulose propellant.

It is also an object of this invention to provide a method for uniformly distributing the components of the propellant uniformly in the binder of the propellant.

It is a further object of this invention to provide a method for formulating a propellant which minimizes the explosive danger in formulating a propellant by eliminating formulating steps such as hot rolling and preextrusion shaping.

It is a further object of this invention to provide a propellant having its components uniformly distributed therethrough.

It is also an object of this invention to provide a propellant which is more easily workable.

These and other objects of the invention are accomplished by forming a slurry of nitrocellulose binder under high shear mixing conditions, adding a plasticizer to the nitrocellulose and recovering the plasticized nitrocellulose. The resultant propellant comprises a nitrocellulose binder having a plasticizer uniformly dispersed therein. Other additives which can be included in the slurry are uniformly dispersed in the nitrocellulose. Such uniform dispersion is made possible by cracks formed in the skin of the nitrocellulose due to the high shear mixing.

DESCRIPTION OF THE PREFERRED EMBODIMENTS

Nitrocellulose, while wetted with alcohol or water, can be slurried at high shear with a liquid. While in this slurry, the nitrocellulose is coated and plasticized when a suitable plasticizer is added to the slurry. The plasticizer is distributed uniformly throughout the NC by this method. Other additives suitable for propellants utilizing NC as a binder for the propellant are also uniformly distributed throughout the NC by this method. The nitrocellulose suitable for use in the method of this invention is any standard nitrocellulose known in the explosives field. However, nitrocellulose having a percentage of nitrogen in the range of 12.0% N to 12.6% N is most suitable for the purposes of this invention. Liquids which serve to wet the nitrocellulose to render it suitable for shipping are alcohol or water or combinations of both. The most common alcohol is non-anhydrous ethanol. The amount of alcohol or water used to wet the nitrocellulose is 25% to 50%, based on the weight of the nitrocellulose.

Suitable liquids in which the nitrocellulose may be slurried are those which are soluble in and/or form an azeotrope with the liquid used to wet the NC. Such liquids are the lower organic hydrocarbons of up to 10 carbon atoms. More suitable liquids are hexane and heptane from a practical engineering standpoint. An appropriate amount of liquid to use to form a slurry is 2 to 8 times the weight of the double-base formulation to be produced. The usual amount is 4 times the formulation weight.

The nitrocellulose may be reslurried as many times as neccessary in order to remove the wetting liquid from the nitrocellulose although the removal of the wetting liquid is optional. The plasticizer is added to the slurry while the slurry is being mixed. The liquid of the slurry is decanted, and the remaining plasticized nitrocellulose is dried and cured. The decanted slurrying liquid can be used in the next mix of the same type. This simplifies the process because any slight solubility of propellant ingredients is automatically compensated by using a liquid that has already reached an equilibrium saturation with the partially soluble materials.

A particularly suitable high speed, high shear mixer is a container having a blade therein. Near the tip of the blade is an impeller. The impeller of the mixer is of circular construction with teeth located around the periphery and producing a highly turbulent area at the tip of the blade. This action produces the high speed, high shear action which incorporates other propellant components in the nitrocellulose binder. A typical high speed, high shear device is a Cowles dissolver. The forming time for any one slurry is up to about 5 hours, and is determined by observation of the mixing.

After a suitable slurry of nitrocellulose has been formed, a plasticizer is added to the slurry. The plasticizer is actually a composition comprising an organic ester and at least one explosive material. The ester and the explosive are premixed before addition thereof to the slurry of nitrocellulose. Some suitable esters are dibutyl phthalate, di-normal propyl adipate, bis (2-ethylhexyl)adipate, diisoctyl adipate, bis(2-ethyl butyl-)azelate, bis(2-ethylhexyl)sebacate, bis(2-ethylhexyl)phthalate and others. These organic esters are inert or non-explosive plasticizers. The explosive materials used in the plasticizer are suitable explosive (or energetic) nitrate ester plasticizers. Typical examples are trimethylolethane trinitrate (TMETN) and triethylene glycol dinitrate (TEGDN). Stabilizers can also be present in the plasticizer composition. Typical stabilizers are ethyl centralite and 2-nitro-diphenylamine. The composition of the plasticizer is usually 1–50% inert plasticizer, 50% to 99% explosive plasticizer, and 1–10% stabilizer all percentages being based on the weight of the total plasticizer composition with 30% to 40% inert plasticizer, 60% to 65% explosive plasticizer and 4% to 7% stabilizer being more suitable. The mixing time for adding plasticizer to propellant is up to about 5 hours and is easily adjusted by observation as are all mixing times suitable for this case.

Amounts of the plasticizer thus formed which are suitable for mixing with the nitrocellulose slurry are substantially equal to the amount of nitrocellulose in the slurry. If the amount of nitrocellulose falls below that of plasticizer, common ballistic salts are added to the nitrocellulose so that the combination substantially equals the amount of plasticizer. Examples of the common ballistic salts are lead carbonate, monobasic copper beta resorcylate, and potassium sulfate. Because of the action of the high-speed, high-shear mixer, these salts are distributed throughout the propellant matrix in a very even pattern. Small agglomerates of the fine salts are reduced to individual particles. Typically these salts are also non-soluble (or slightly soluble) and non-reactive with the slurrying liquid and, therefore, the chemical integrity of the salts is maintained. Up to about 10% by weight based on the nitrocellulose can be ballistic modifiers.

Drying and curing times range up to 7 days. Drying and curing temperatures range from ambient temperature up to 190° F. It is also possible to vary the temperature during the curing time. Changes in the temperature per day are especially suitable. An especially suitable drying method includes one day at ambient temperature, two days at 140° F. and one day at 170° F.

To examine the results of the high-shear high-speed formulated propellant, photomicrographic analysis of the material is conducted. Apparently during mixing the violent action of the high-speed, high-shear impeller causes the outer skin or cuticle of the nitrocellulose fiber to crack. This is the mechanism that allows the plasticizer to enter and plasticize the NC fiber without the use of any additional mechanical working as in the prior art.

The following examples are intended to illustrate and not unduly limit the scope of the invention. All parts and percentages are by weight unless otherwise specified.

EXAMPLE I

In a device suitable for producing a high shear, high speed action such as a Cowles dissolver, 3.1 pounds alcohol wet NC (nitrocellulose) is slurried with 15 pounds hexane at ambient temperature. The slurry is allowed to settle, and the hexane-alcohol is decanted. The material is reslurried in 15 additional pounds hexane. The slurry is allowed to settle and the hexane-alcohol is decanted. The material is again reslurried in 15 additional pounds hexane. The slurry is allowed to settle and the hexane-alcohol is decanted. The slurry is removed from the Cowles dissolver and placed in a standard mixer such as a 5-gallon Baker-Perkins mixer. The mixer is run slowly for 10 minutes at 70° F. to reslurry the NC-hexane. The premixed plasticizer consisting of 1.927 pounds TMETN, 0.150 pound TEGDN, 0.420 pound dibutyl phthalate and 0.098 pounds ethyl centralite is added. The mixer is run at 70° F. for 20 minutes, and then the mixer is placed on full vacuum and run for two (2) hours to remove all hexane. The mix is cured for 3 days at 130° F. The mix is extruded at 120° F.

EXAMPLE II

In a Cowles dissolver, a slurry is prepared of 3.1 pounds of alcohol wet NC in 30 pounds of heptane at 70° F. for 20 minutes. The NC slurry appears smooth and "creamy". Without stopping the Cowles dissolver the premixed plasticizer, consisting of 2.118 pounds TMETN, 0.0168 pounds TEGDN, 0.462 pounds dibutyl phthalate, 0.108 pounds ethyl centralite and 0.865 pounds methanol is added. The NC is observed to begin to plasticize less than one minute after plasticizer addition is initiated. Without stopping the Cowles the mixing is continued for 5 minutes more. The Cowles is then stopped and the slurry allowed to settle. The residual heptane-methanol is decanted. The mix is spread on a tray and air dried/cure for 4 days. The mix is extruded at 160° F.

EXAMPLE III

In a Cowles dissolver, 7.73 pounds of water-wet NC is slurried in 48 pounds of heptane, for 45 minutes at ambient temperature. A mixture of 5.47 pounds of TMETN, 0.446 pounds of TEGDN, 2.39 pounds of dibutyl phthalate, 0.416 pounds of ethyl centralite and 0.012 pounds of candelilla wax is added to the slurry over a period of 15 minutes. The slurry is allowed to settle and the heptane is decanted (for reuse in a later mix). The heptane-damp material is placed in trays and dried in an airdraft over (no heat) for 1 day. The temperature of the oven is then raised to 140° F. for 2 days and 170° for 1 day, sequentially a photomicrographic analysis of the thus formed material has been conducted. Apparently during mixing the voilent action of the high-speed, high-shear impeller causes the outer skin or cuticle of the nitrocellulose fiber to crack. This is the mechanism that allows the plasticizer to enter and plasticize the NC fiber without the use of any additional mechanical working as in the prior art.

EXAMPLE IV

In a Cowles dissolver, 7.73 pounds of water-wet NC is slurried in 30 pounds of heptane from the previous example and 11 pounds of new heptane, for 30 minutes at ambient temperature. A mixture of 4.620 pounds of TMETN, 0.360 pounds of TEGDN, 1.008 pounds of dibutyl phthalate, 0.240 pounds of ethyl centralite and 0.012 pounds of candelilla wax is added to the slurry slowly over a period of 15 minutes. After addition, the mixing of the slurry is continued for 30 minutes. The slurry is allowed to settle and the heptane is decanted (for reuse in a later mix). The heptane damp material is placed in trays and dried in an air-draft over (no heat) for 1 day. The temperature of the oven is then raised to 140° F. for 2 days and 170° F. for 1 day. The material is then extruded in a 2 inch vacuum press at 140° F. into strands.

EXAMPLE V

In a Cowles dissolver, 6.2 pounds of water-damp NC, 0.613 pounds dinormal propyl adipate, 0.080 pounds 2-nitrodiphenylamine (2-NDPA), 0.506 pounds TMETN, 0.056 pounds TEGDN, 0.084 pounds monobasic copper beta resorcylate are slurried in 48 pounds of heptane. The small amounts of plasticizer were added to approximate the saturation equilibrium concentration in the heptane. The slurry was processed for 30 minutes. To this slurry, a mixture of 4.80 pounds TMETN, 0.60 pounds TEGDN, 0.12 pounds dinormal propyl adipate and 0.24 pounds 2-NDPA were added slowly over a 10-minute period. The mixing was continued for 80 additional minutes. The heptane was decanted and used in a later mix. The propellant was dried 2 days at ambient temperature and cured 2 days at 140° F. and one day at 170° F.

Obviously, many modifications and variations of the present invention are possible in the light of the above teachings. It is, therefore, to be understood that within the scope of the appended claims the invention may be practiced otherwise than as specifically described.

What is claimed as new and desired to be secured by Letters Patent of the United States is:

1. A method for preparing a double-base propellant comprising:
   a. forming a slurry of nitrocellulose by mixing the nitrocellulose with a liquid under high speed, high shear conditions;
   b. adding a plasticizer to the slurry to form a plasticized nitrocellulose, and
   c. drying and curing the plasticized nitrocellulose.

2. The method of claim 1 wherein step (a) comprises forming the slurry of ntrocellulose by mixing the nitrocellulose with the liquid under high speed high shear conditions, settling the slurry, decanting the liquid, reslurrying the nitrocellulose in a liquid.

3. The method of claim 2 wherein the nitrocellulose is alcohol wet, the liquid is heptane, or hexane and the nitrocellulose is reslurried in heptane or hexane.

4. The method of claim 3 wherein the plasticizer is added during the mixing of the slurry.

5. The method of claim 2, wherein the liquid used to reslurry the nitrocellulose is decanted and step (b) comprises mixing to again reslurry the nitrocellulose adding the plasticizer to the slurry thus formed, and mixing.

6. The method of claim 1 wherein the drying and curing time is up to 7 days, and the drying and curing temperature ranges from ambient to 190° F.

7. The method of claim 6 wherein the drying and curing comprises a first day at ambient temperature, a second and third day at 140° F., an a forth day at 170° F.

8. The method of claim 6 wherein the curing temperature is varied during the curing time.

9. The method of claim 1 wherein the nitrocellulose is wet with water and slurrying and decanting are repeated until the desired amount of water is removed.

10. The method of claim 1 wherein the nitrocellulose is alcohol wet, and slurrying and decanting are repeated until the desired amount of alcohol is removed.

11. The method of claim 8 wherein the liquid is a lower hydrocarbon.

12. The method of claim 11, wherein the liquid is heptane or hexane.

13. The method of claim 12 wherein the plasticizer contains 1–50% inert plasticizer, 50–99% explosive plasticizer, and 1-10% stabilizer.

14. The method of claim 13 wherein the inert plasticizer is d-n-butyl phthalate or diiobutyl phthalate; the explosive plasticizer is metriol trinitrate, triethylene gylcol dinitrate, or mixtures thereof, and the stabilizer is ethyl centralite.

15. The method of claim 14 wherein the amount of nitrocellulose in the slurry is 10%–50% based on the weight of the slurry.

16. The method of claim 1, wherein the liquid contains a ballistic modifier.

* * * * *